US005249406A

United States Patent [19]

Kalmanides

[11] Patent Number: 5,249,406

[45] Date of Patent: Oct. 5, 1993

[54] BOX CLOSING APPARATUS

[76] Inventor: Dan Kalmanides, 620 Grassy Hill Rd., Orange, Conn. 06477

[21] Appl. No.: 986,550

[22] Filed: Dec. 7, 1992

[51] Int. Cl.[5] ..... B65B 7/26; B65B 51/00

[52] U.S. Cl. ..... 53/377.5; 53/377.6; 53/387.2

[58] Field of Search ..... 53/484, 491, 375.4, 53/377.6, 377.5, 387.2, 329

[56] References Cited

U.S. PATENT DOCUMENTS

| | | | |
|---|---|---|---|
| 2,842,920 | 7/1958 | Carkhuff et al. | 53/377.6 X |
| 2,998,688 | 9/1961 | Randles, Jr. | 53/377.5 |
| 3,299,615 | 1/1967 | Singer | 53/377.5 |
| 3,550,352 | 12/1970 | Voorhis | 53/377.5 X |
| 4,030,272 | 6/1977 | Gundersen | 53/377.5 X |
| 4,881,356 | 11/1989 | Beezer et al. | 53/377.6 X |

*Primary Examiner*—Horace M. Culver
*Attorney, Agent, or Firm*—John K. Conant

[57] ABSTRACT

This is apparatus for closing a box of the type having a hinged cover and flanges projecting from the edges of the cover and body opposite the hinged edges. The flanges have respectively a projection and a well aligned and constructed for the projection to snap into the well when the cover is closed and the flanges are pressed together. A conveyor belt carries the box from a first point along a path past a pair of spaced apart rotating rollers which are mounted edge to edge. A guide rail above the conveyor is positioned and curved to engage the outside of the box cover and swing it over onto the body of the box as the box is carried to the rollers. The rollers are located and spaced apart for the flanges on the cover and body of the box to pass through the bite of the rollers as the box is carried by. They are rotated in opposite directions for their surfaces at their bite to be moving in the same direction and at the same speed as the conveyor belt and they are spaced close enough together to press the flanges together sufficiently for the projection on one flange to be pressed into and locked in the well of the other flange as the flanges pass through the bite.

14 Claims, 4 Drawing Sheets

BOX CLOSING APPARATUS

BACKGROUND OF THE INVENTION

The present invention is an apparatus for closing the type of box that has a cover hinged to the body portion and is locked in closed position when the cover is swung over onto the body portion and flanges that extend out from the front edges of the cover and body portion, respectively, are pressed together so that one or more projections or buttons on one of the flanges is forced into mating well or wells in the other flange and snaps into locked relation therein. This type of locking means is sometimes referred to as a press-button snap lock closure.

These types of boxes on the the press-button snap lock type of closures are used are customarily made of thin plastic so that their walls are naturally relilient and flexible. The locking of th box cover in closed position is provided by pressing the one or more projections or buttons on one flange into the mating well or wells in the opposing flange. The projections or buttons are undercut at their bases so that they are larger at their outward ends than at their bases. The openings of the mating wells are made slightly narrower than the outer ends of the projections but the other portions of the wells are large enough to accommodate the mating projections. Thus, due to the natural flexibility and resilience of the thin plastic walls of the box, the projections or buttons snap into and are retained in the mating wells when the box cover is swung over onto the box body portion until the flanges are together with the projections or buttons studs alligned with the mating wells and the flanges pressed together to push the projections or buttons into the wells.

Boxes of this type are currently used for packaging bakery products such as muffins. The boxes are preferably made of a clear plastic that is rigid but flexible when it is formed into thin walled boxes. Thus the goods in the boxes are clearly visible for sales appeal, are rigid enoungh to protect the contents and are thin walled enough to keep the cost down and to make possible the simple and effective projection and well locking system just described above.

The box closing apparatus of this invention is particularly adapted for closing and locking boxes of the foregoing type. Heretofore boxes of this type as used on production lines in commercial bakeries for example have been filled and closed by hand. That is, open boxes moving along on a conveyor belt are filled with muffins or other products by hand at one work station and then closed and locked in closed condition by hand at another work station. Pressing the flanges of these boxes together to snap the projections or buttons into the mating wells is particularly fatiguing and irksome for the workers and is the type of hand work motion that is likely to cause carpal tunnel syndrome.

Up to this time there has not been available any suitable or effective machine or apparatus to automate the tedious and potentially damaging work of closing and locking these boxes so that it has had to be done by hand up until now.

BRIEF SUMMARY OF THE INVENTION

The present invention is apparatus that eliminates the need to close and lock these boxes by hand. With the apparatus of this invention a box of the above described type is placed on a moving conveyor belt in open condition so that it can be loaded with a product, such as muffins. Then as the box is carried along by the conveyor a guide rail mounted along the path of the conveyor to be at the outside of the cover of the open box swings the cover up and over into closed position in which the flanges on the outer edges of the cover and body of the box are in opposed relation with the projections from one flange in line with the openings of the mating wells in the other flange. Then further movement of the box along the conveyor carries it past a pair of power driven rollers that are mounted edge to edge to rotate about parallel axes that are at right angles to the direction of movement of the conveyor belt. The rollers are rotated in opposite directions and in directions so that their surfaces at their bite move in the same direction and in the direction in which the conveyor belt moves.

The rollers are dimensioned and spaced apart for the opposed flanges to pass into the bite of the rollers. The bite is made narrow enough to press the flanges together sufficiently to force the projections on one of the flanges into the wells in the other flange far enough for the projections to snap into and thus be locked in the mating wells.

PRIOR ART

Guide rails or bars arranged to swing box covers over into closed position as the boxes or cartons are carried along on a convyor belt are well known. For example, see U.S. Pat. No. 3,267,637 to T. R. Baker and U.S. Pat. No. 3,299,615 to M. E. Singer.

Also attempts have been made to provide automated apparatus for latching in locked condition press-button snap lock closures. For example, see U.S. Pat. Nos. 3,877,205 and 4,030,272 to Gundersen. These Gundersen patents show fingers or spokes on rotating wheels for pressing projections or buttons into locking relation in mating wells for locking a box cover in closed position on a box. But these systems require that the locking motion of the fingers or spokes by indexed to the movement of the boxes along the conveyor or that some type of trigger mechanism be provided to actuate the movement of the finger or spoke at the precise moment a projection or button and mating well on the box and cover come into operative alignment with the finger or spoke.

A particular object and advantage of the apparatus of the present invention is that no special mechanisms are needed to index the movement of the box with the operation of the locking apparatus. The structure of the apparatus of this invention is simple and economical to contruct and to operate. The projections on one flange are pressed into the mating well in the other flange of a box and cover whenever a box is conveyed past the rollers, which do the locking, without regard to the speed of the conveyor or the longitiudinal position of the box on the conveyor. Also the speed of the conveyor which carries the past the rollers may be increased or decreased as desired, to accomodate the loading of goods into the boxes, for example, without having to separately adjust the speed of rotation of the rollers. Moreover, the structure and mode of operation of the roller locking mechanism of this invention is such that no forces are applied during the locking step which could scew a box on the conveyor or cause it to skid or tip which could cause an incomplete closure or perhaps damage the box and necessitate shutting the apparatus down in order to correct the malfunction.

DESCRIPTION OF THE DRAWINGS

Further objects, advantages and features of the apparatus of this invention will be apparent from the following detailed description of an illustrative embodiment of the invention shown in the accompanying drawings in which.

DETAILED DESCRIPTION

Figure 1:
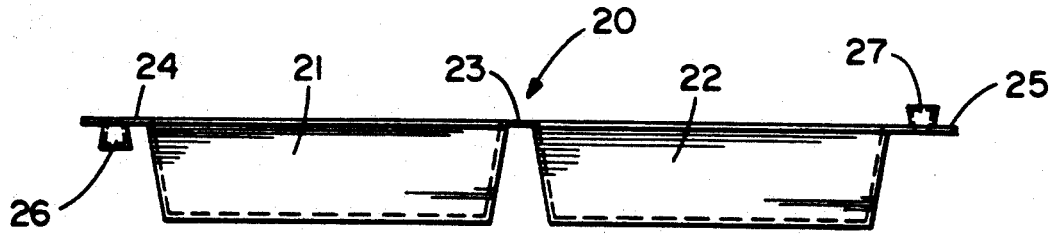
FIG. 1 is a side elevation of a type of box which the apparatus of this invention is adapted to close.
Figure 2:
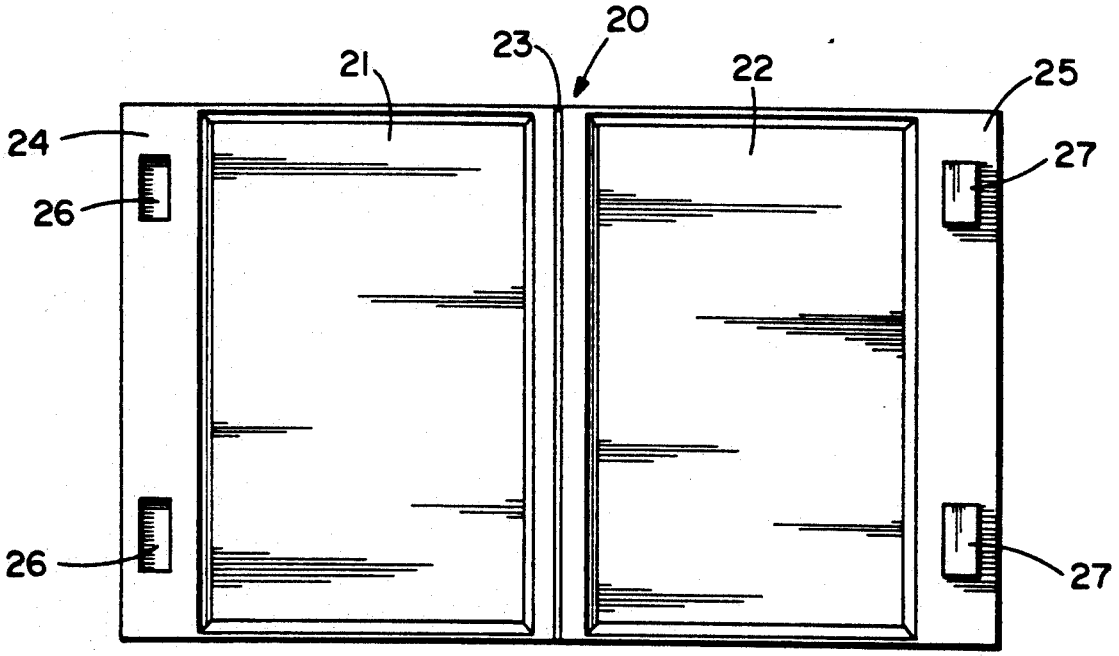
FIG. 2 is a top plan view of the box shown in FIG. 1.
Figure 3:
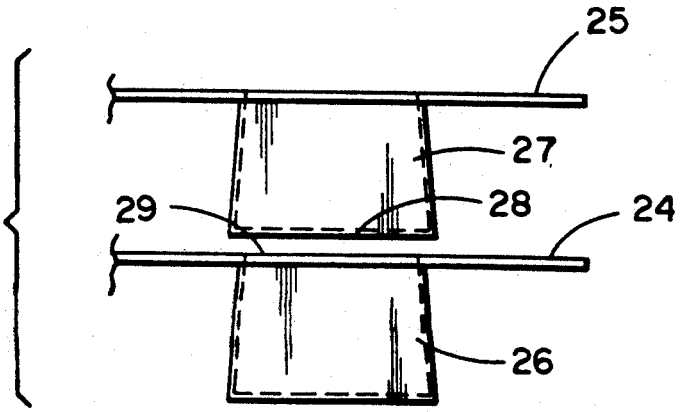
FIG. 3 is and elarged cross sectional view illustrating the the type of locking arrangement by which the cover of a box of the type shown in FIGS. 1 and 2 is locked in closed position when the cover is closed.

Referring now to the drawings, the apparatus 10 (shown in FIGS. 4 and 5) of this invention is particularly adapted for closing and locking in closed position a box 20 of the type illustrated in FIGS. 1, 2 and 3.

The box 20 shown is a type presently used for bakery goods, such as muffins. It is made of a clear plastic which is thin but stiff. It consists of a bottom portion 21 joined along one edge to a cover portion 22 by a narrow intermediate hinge section 23, in which the thickness of the plastic is made thinner along its center line to form what is know as a 'living hinge', which enables the cover portion to be folded easily over onto the bottom portion to close the box.

The bottom and cover portions 21 and 22 of the box each have a flange, 24 and 24, respectively, extending outward from their edges that are opposite the hinged edge. The flange 24 has at least one, and preferably two, rectangular wells 26 in it and the flange 25 has at least one, and preferably two, rectangular projections 22. As indicated in FIG. 3 the wells 26 are shaped and aligned to receive therein in mating relation the projections 27 when the box cover portion 22 is folded over the bottom portion 23. Also, as shown, the outer ends 28 of the projections 28 are wider than their bases and are similarly wider in width than the openings 29 of the wells 26. These widths are made such that when the cover 22 is folded over the bottom 21 and the flanges 24 and 25 are pressed together the projections 27 can be forced into the wells 26 with a little pressure. The plastic of which the box is made is sufficiently rigid and flexible that as the projections 27 are pressed into to wells 26 they can be forced in and when they are part way in, with their relatively larger ends 28 just past the narrowest part of the well openings 29, they snap the rest of the way in and form a dovetail form of interlock, locking the cover 22 in closed position over the bottom 21.

Figure 4:
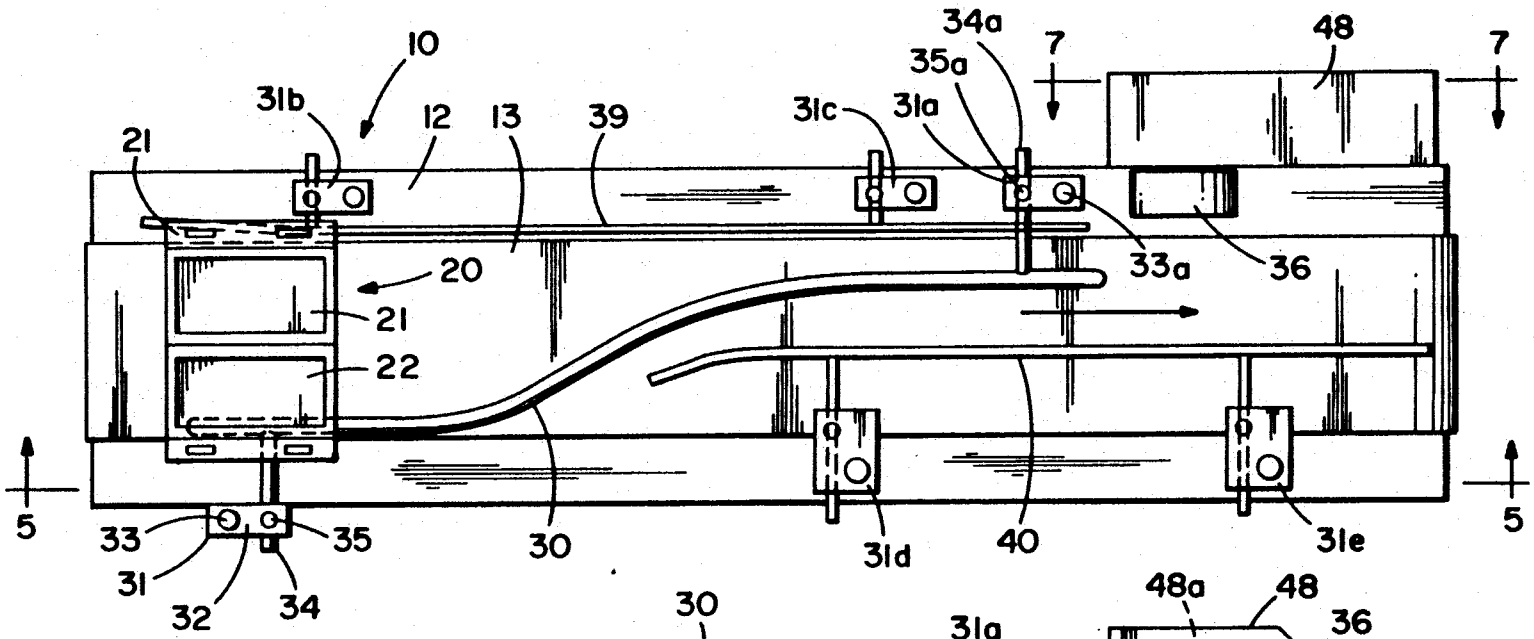
FIG. 4 is a top plan view of apparatus in accordance with this invention.
Figure 5:
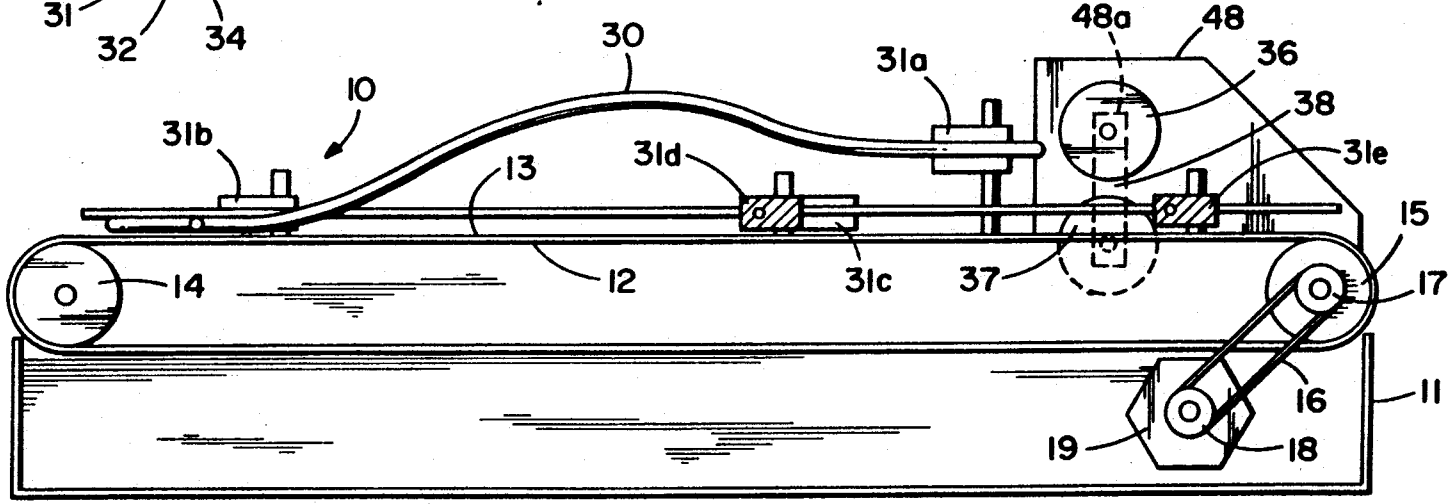
FIG. 5 is a view taken along the lines 5—5 of FIG. 4.
Figure 6A:
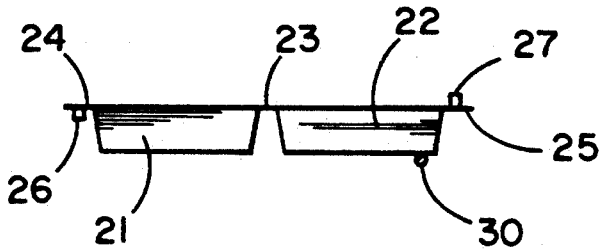
FIGS. 6*a*, 6*b*, 6*c* and 6*d* are side elevational views of a box of the type shown in FIGS. 1 and 2 illustrating in sequence the manner is which the cover is moved from an open to a closed position by the apparatus of this invention.
Figure 6B:
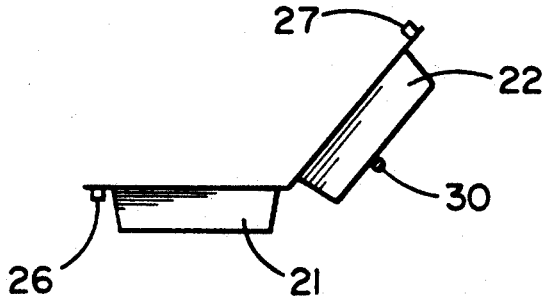
Figure 6C:
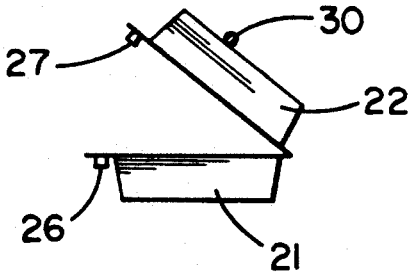
Figure 6D:
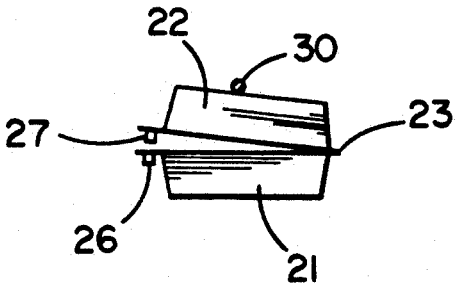

Referring now to FIG. 4 and 5, the apparatus 10 has a frame, indicated at 11, with an elongated flat table top 12 on top of the frame. An endless conveyor belt 13 is carried around rolls 14 and 15 which are journalled in the ends of the frame 11 with the upper run of the conveyor belt moving longitudinally over and supported by the table top 12.

The conveyor belt 13 is driven by a drive belt 16 around a pulley 17 fixed on the end of roll 15 and around a pulley 18 that is pinned on the drive shaft of a motor 19 which is mounted on the frame 11.

A tubular guide bar 30 is mounted on the table top 12 to extend longitudinally over a major portion of the conveyor belt 12. At the left hand end of the table top 12 the left hand end of the guide bar is mounted close to the surface of the conveyor belt by a support mount 31 which consists of a block 32 which is slideable up and down on a verticle post 33 extending up from the table top and held in an adjusted position on the post 33 by a set screw, not shown, A horizontal rod 34 attached to the guide bar 30 is slideably received through the block 32 and held in adjusted position therethrough by a set screw indicated at 35. Similarly the right hand end of the guide bar 30 is mounted above the conveyor belt 13 by a support mount 31*a* consisting of a block 32*a* slideable on verticle post 33*a* through which is carried a horizontal rod 34*a* which attached to the guide bar 30. The block 32*a* is held in adjusted position on the post 33*a* by a set screw, not shown, and the 34 34*a*, and hence the right hand end of the guide bar 30, is held in adjusted position by a set screw indicated at 35*a*. Thus the positions of the guide rod 30 up and down and horizontally are adjustable The guide bar 30 is generally sinuous, but its curvature is more accurately described as being the curvature one would generate by grasping the two ends of a circular loop of stiff wire, one in each hand, and pulling them apart to an extent not great enough to straighten the wire and then moving one end up and forward. In any event the guide bar 30 is curved in such a fashion as to fold the cover 22 of a box 20 that is on the conveyor belt up and over onto the bottom 21 of the box as the box is carried from the left end of the conveyor belt to the right end. As illustrated in FIG. 4 the guide bar 30 is positioned so that its left end end is close to the surface of the conveyor belt 13 and under the cover 22 of a box 20 that is on the conveyor belt. Then as the box is carried along on the conveyor, after items such as muffins have been placed in it, the guide bar folds the top 22 up and over onto the bottom 21 of the box as illustrated in FIGS. 6*a* through 6*d*.

Near the right hand end of the conveyor belt 13, at the side of the conveyor belt, as shown in FIGS. 4 and 5, are mounted a pair of rollers 38 and 39 in vertical, edge to edge relation and spaced slightly apart. In a manner explained more fully below the rollers are driven in opposite directions so that at their bite 38 their surfaces are moving in the same direction, as indicated by the arrows in FIG. 5, which is the direction in which the upper run of the conveyor belt 13 runs, as indicated by the arrow on the conveyor belt 13 shown in FIG. 4.

As a box 20 is carried along on the conveyor belt 13 it is held in lateral alignment on the belt by guide rails 39 and 40 which are adjustably mounted on the table top 12 at opposite sides of the conveyor belt 13 by support mounts 31*b*, 31*c* and 31*d*, 31*e* respectively. These support mounts 31*b* through 31*e* are similar in construction and operation to the support mounts 31 and 31*a* previously described and thus are adapted to adjust the width and lateral position of the path along which a box 20 is carried by the conveyor belt 13. This adjustment, like the adjustment of the position of the guide rod 30, adapts the apparatus for use with different size boxes.

As shown in FIG. 4 a box 20 on the left hand end of the conveyor belt 13 is positioned with the side of its bottom portion that is opposite its hinged side against the guide rail 39, whose height is adjusted so that the flange 21 on that side of the box is above the guide rail 39. The guide rail 39 and the guide rail 40 are in adjusted lateral position for the flange 24 of the box bottom 21, and hence also the flange 25 of the box cover 22 when folded over the bottom by the guide rod 30, to pass through the bite 38 of the rollers 36 and 37 as the conveyor belt carries the box to the right hand end of the conveyor belt.

The height of the right hand end of the guide bar 30 above the conveyor belt 13 is adjusted so as to bring the cover 22 of the box down toward the bottom 21 just far enough for the projections 27 to be over, but not in, the wells 26 at the point at which the conveyor belt has carried the box up to the bite 38 of the rollers 37, 38. As stated above the rollers 37, 38 are at a height for the flanges 24 and 25 of the box to enter the bite 38 as the conveyor belt carries the box to the right past the rollers 37, 38 and the rollers are spaced apart but are close enough together for them to press the flanges 24 and 25 together sufficiently for the projections 27 to be pushed far enough into the wells 26 for them to snap all the way into the wells, as previously described, thereby locking the box cover 22 in closed position on bottom 21.

The rollers 36 and 37 are rotated at the same surface speed as the conveyor belt 13. This assures that the force applied by the rollers to the box flanges 24 and 25 will not skid or scew the box as it passes by the rollers. Additionally this renders it unneccessary to have to index the movement of the box up to and past the locking mechanism, which is provided by the rollers 36 and 37 in this apparatus.

Figure 8:
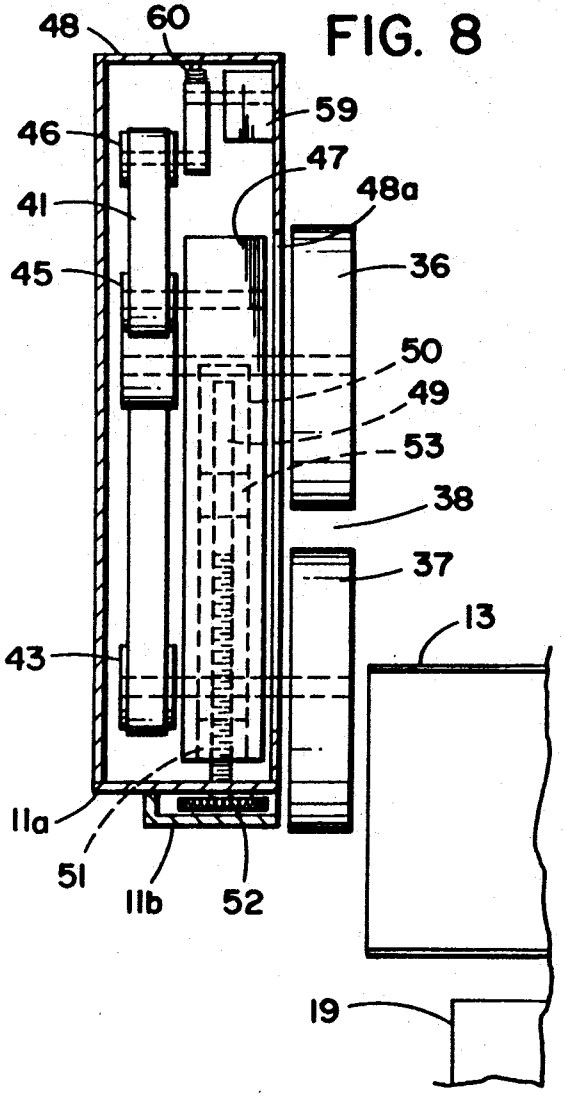
FIG. 8 is a view taken along the lines 8—8 of FIG. 7.
Figure 7:
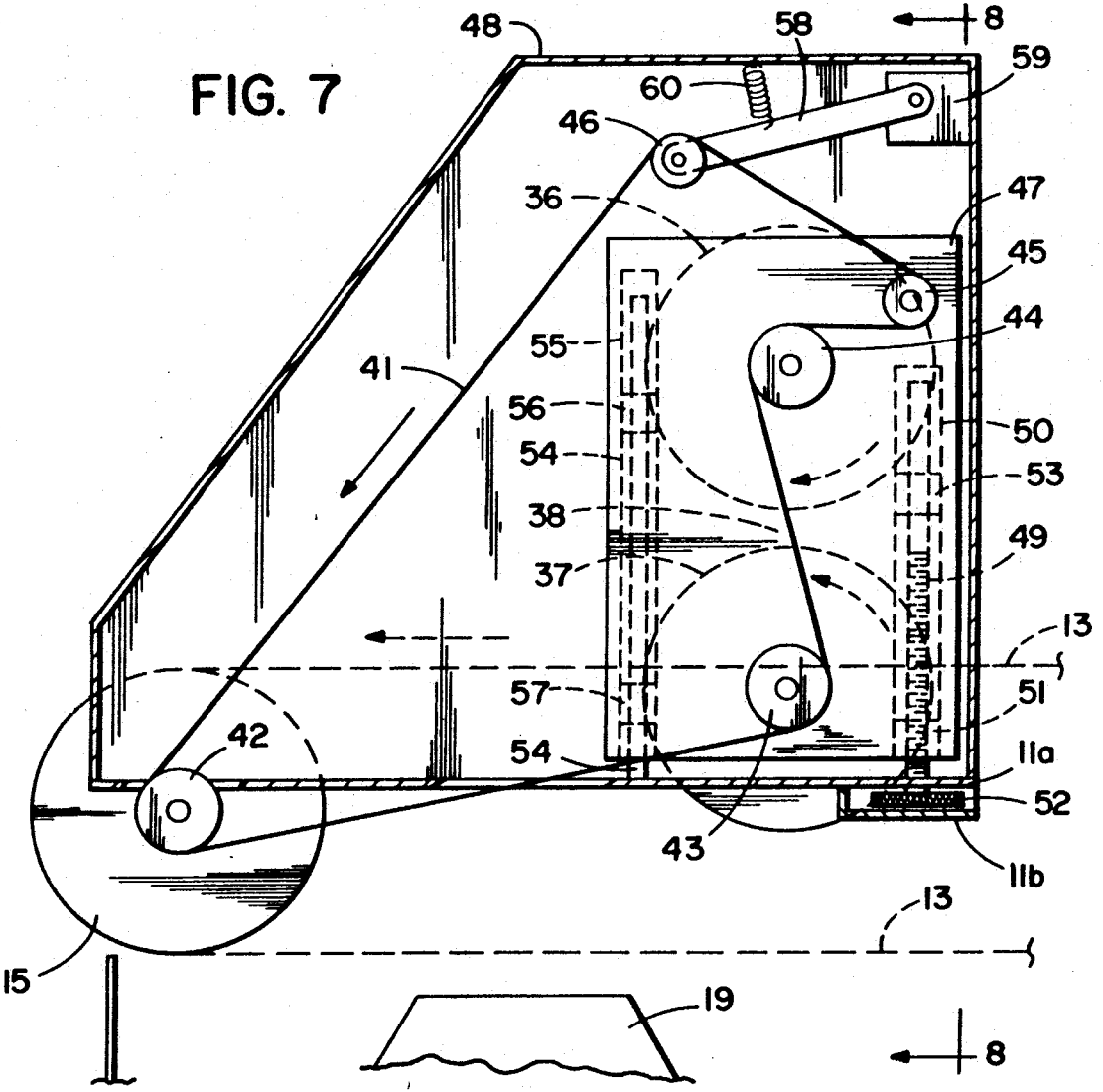
FIG. 7 is view taken along the lines 7—7 of FIG. 1.

Referring now to FIGS. 7 and 8 the surface speed of the rollers 36 and 37 is arranged to be the same as the surface speed of the conveyor. This is provided by power driving the rollers from one of the conveyor rolls, roll 15, by making the rollers 36 and 37 the same diameter as the conveyor roll 15 and by having all the driving pulleys of the drive connection the same diameter. As shown the drive connection is by a drive chain 41 which passes around a pulley 42 fixed on the axle of the conveyor roll 15, around a pulley 43 fixed on the axle of the roller 37, around a pulley 44 fixed on the axle of the roller 36, around an idler roller 45, around an idler roller 46 and back to the pulley 42 on the axle of conveyor roll 15. The rollers 36 and 37 are rotated in opposite directions for their surfaces at the bite 38 between them to be moving in the same direction, indicated by a dashline arrow, by having the drive chain 41 pass in opposite directions around the pulleys 43 and 44 which are fixed on the axles of the rollers 37 and 36, respectively.

Still referring to FIGS. 7 and 8, the rollers 36 and 37 are mounted for their height relative to the conveyor belt 13 to be adjusted as desired to accomodate boxes of different sizes. For this purpose the rollers 36 and 37 are journalled on a verticle plate 47 which is carried for slideable up and down movement in a housing 48, which has a suitable opening, indicated at **48*a*, through its side wall to permit this movement. The plate 47 is moved to an adjusted verticle position by means of a rod 49 extending vertically up from a frame memeber 11*a*, which forms the bottom of the housing 48, up into an elongated vertical well 50 in the plate near the right hand edge of the plate as viewed in FIG. 7. The lower end portion of the rod 49 is threaded through a threaded sleeve 51 that is fixed in the bottom end of the well 50. The lower end of the rod 50 extends down through a suitable opening through the frame portion 11*a* with a knurled thumb wheel 52 fixed on the bottom end of the rod. The thumb wheel 52 is captured between the underside of the frame portion 11*a* and a frame piece 11*b* which is in the nature of a shelf spaced below and parallel to the frame portion 11*a*. Thus the rod 49 is prevented from moving vertically when the thumb wheel is turned and the threaded lower portion of the rod 49 turning in the threaded sleeve 51 in the well 50 moves the plate 47, and hence the rollers 36 and 37**, up or down, depending on the direction in which the thumb wheel is turned.

The upper end of the rod 49 moves through a bearing 53 mounted in the well 50 to support and guide the vertical movement of the plate. At the left hand edge of the plate another vertical rod 54 with its bottom end fixed on the frame portion **11*a* extends up into an elongated well 55 in the plate through bearings 56 and 57 mounted in the well 55** to hold the plate in alignment as the plate is moved up or down.

The idler roll 45 is mounted on the plate 47 and the drive connection by appropriate tension of the drive chain 41 is maintained in different verticle positions of the plate 47 by the other idler roll, idler roll 46, being mounted on an arm 58 that is pivotally mounted on a block 59 on the housing 48. The ider roll 46 is held in pressure contact with the drive chain 41 in all verticle positions of the plate 47 by a coil spring 60 connected between the arm 52 and the housing 48 and biased to urge the arm 58 to pivot upward so as to maintain the tension of the drive chain 41.

In operation a box 20 is placed in open condition on the left hand end of the conveyor belt 13 and items, such as muffins, are placed in the bottom 21 of the box. Then as the conveyor belt 13 carries the box along to the right to the rollers 36 and 37 the guide bar 30 swings the box cover 22 up and over onto the box bottom 21. Then as the box is moved past the rollers the flanges 24 and 25 on the box bottom and cover, respectively, pass into and through the bite 38 of the rollers 36 and 37 which press the flange projections 27 into the flange wells 26 far enough to cause the projections to snap the rest of the way into the wells and thus lock the box in closed condition.

What is claimed is:

1. Apparatus for closing a box and latching it closed, which box has a cover joined along one edge to a body portion by a hinge with each of the cover and body portion having a flange projecting outward in a plane from edges opposite from said hinge with one of said flanges having a projection adapted to be received in a well in the other of said flanges and to be locked therein by cooperating locking means on said projection and said well when said cover is folded over onto said body portion and said flanges are pressed together;

a movable, generally horizontal, surface for supporting one of said boxes and moving it in a direction along a predetermined path from a first point to beyond a second point on said path;

motor means connected for moving said generally horizontal surface along said path;

means for holding a said box aligned on said generally horizontally surface with said hinge longitudinally parallel with the direction of said path;

means for swinging said cover of a said box that is on said generally horizontal surface with said cover in open position relative to said body portion over and down toward said box body portion and bringing said flanges close together with said projection on said one flange at but not in said well in said other flange when said box is moved by said generally horizontally surface to said second point;

a pair of rollers spaced apart at said second point on said path, mounted in edge to edge relation to rotate about parallel axes that are at right angles to the direction of said path and located at a side of said path for the flanges of a said box moving along said path to pass into and through a bite between said rollers; and the spacing between said rollers being such that when a said box is moved by said generally horizontal surface past said second point said flanges are pressed close enough together by said rollers for said projection on said one flange to be pressed far enough into said well on said other flange for said locking means to lock said projection in said well, thereby locking said cover in closed position on said said box body portion.

2. The apparatus of claim 1 in which said means for swinging said box cover over and down toward said box body portion comprises a guide bar mounted above said path and extending from said first point to a point at least close to said second point, the end of said guide bar at said first point being positioned relative to a said box that is in said alignment at said first point on said surface to be at the outside of said cover when said cover is in open position retative to the body portion of said box;

said guide bar curves progressively upward, partially across said path and then downward for swinging the cover of a said box, which is on said surface and moving from said first point toward said second point, over and down toward the body portion of said box for said flanges to be brought close enough together when said box arrives at said second point for said projection on said one flange to be at, but not in, said well in said other flange.

3. The apparatus of claim 1 which includes power means connected to rotate said rollers in relatively opposite directions so that roller surfaces move in the, same direction through the bite between said rollers and to rotate said rollers so that at said bite said roller surfaces move in the direction of movement of said generally horizontal surface along said path.

4. The apparatus of claim 3 in which said power means is connected to rotate said rollers at the same surface speed as said generally horizontal support surface is moved.

5. The apparatus of claim 4 which includes means for moving said rollers up and down relative to said generally horizontal support surface and moving them in unison in their same spaced apart relation.

6. Apparatus for closing a box and latching it closed, which box has a cover joined along one edge to a body portion by a hinge with each of the cover and the body portion having a flange projecting outward in a plane from edges opposite from said hinge with one of said flanges having a projection therefrom adapted to be received in a well in the other of said flanges and to be locked therein by cooperating locking means on said projection and said well when said cover is folded over onto said body portion and said flanges are pressed together;

a conveyor belt having an upper surface for supporting one of said boxes and carrying it in a direction along a predetermined path from a first point to beyond a second point on said path;

power drive means connected for moving said belt upper surface along said path including a roll in frictional driving contact with said conveyor belt and motor means connected to rotate said roll for moving said belt surface along said path;

means for holding a said box aligned on said surface with said hinge longitudinally parallel with the direction of said path;

means for swinging said cover of a said box, which is on said conveyor belt upper surface with said cover in open position relative to said body portion, over and down toward said body portion and bringing said flanges close together with said projection on said one flange at, but not in, said well on said other flange when said box is moved by said conveyor belt surface to said second point;

a pair of rollers spaced apart in edge to edge relation at said second point and mounted to rotate about parallel axes that are at right angles to the direction of said path and located at a side of said path for the flanges of a said box moving along said path to pass into and through a bite between said rollers; and the spacing between said rollers being such that when a said box is moved by said conveyor surface past said second point so that said flanges pass through said bite said flanges are pressed close enough together by said rollers for said projection on said one flange to be pressed far enough into said well on said other flange for said locking means to lock said projection in said well, thereby locking said cover in closed position on said box body portion.

7. The apparatus of claim 6 which includes means for moving said rollers vertically up and down relative to said conveyor belt upper surface in unison and in their same spaced relation.

8. The apparatus of claim 6 which includes power drive means connected for rotating said rollers in opposite directions so that roller surfaces at the bite between said rollers move in the same direction as the direction in which said upper surface of said conveyor belt is moved.

9. The apparatus of claim 8 which includes means for rotating said rollers at the same surface speed at which said conveyor belt upper surface is moved.

10. The apparatus of claim 9 in which said means for rotating said rollers at the same surface speed as said conveyor belt surface comprises a first pulley drivingly connected to said roll of said conveyor belt driving means, a second pulley drivingly connected to one of said rollers, and a third pulley drivingly connected to said other roller, said pulleys all being the same diameter and all being driven by a drive chain that is around all three of said pulleys so as to be driven by the power driven rotation of said conveyor belt roll.

11. The apparatus of claim 10 in which said three pulleys are drivingly connected to said roll and said rollers respectively by being fixed axially thereon.

12. The apparatus of claim 11 in which said rollers are mounted for movement up and down relative to said conveyor belt upper surface in unison and in the same spaced relation by being mounted on a vertical plate that is movable vertically up and down, and which includes means for moving said plate up and down to selected positions of vertical adjustment.

13. Apparatus for closing a box and latching it closed, which box has a cover joined along one edge to a body portion by a hinge with each of the cover and body portion having a flange projecting outward in a plane from edges opposite from said hinge with one of said flanges having a projection adapted to be received in a well in the other of said flanges and to be locked therein by cooperating locking means on said projection and said well when said cover is folded over onto said body portion and said flanges are pressed together;

a movable, generally horizontal, surface, for supporting one of said boxes and moving it in a direction along a predetermined path from a first point to beyond a second point on said path;

motor means connected for moving said generally horizontal surface along said path;

means for holding a said box aligned on said generally horizontal surface with said hinge longitudinally parallel with the direction of said path;

a guide bar mounted above said path extending from said first point to a point at least close to said second point, the end of said guide bar at said first point being positioned relative to a said box that is in said alignment at said first point on said generally horizontal surface to be at the outside of the cover of said box when said cover is in an open position relative to the body portion of said box;

said guide bar curving progressively upward, partially across said path and then downward for swinging the cover of a said box, which is on said generally horizontal surface and moving from said first point toward said second point, over and down toward the body portion of said box for said flanges to be brought close enough together when said box arrives at said second point for said projection on one said flange to be at, but not in, said well in the other said flange, a pair of rollers spaced apart at said second point on said path, mounted in edge to edge relation to rotate about parallel axes that are at right angles to the direction of said path and located at a side of said path for the flanges of a said box moving along said path to pass into a bite between said rollers;

power means connected to rotate said rollers in relatively opposite directions so that roller surfaces move in the same direction through the bite between them and to rotate said rollers so that at said bite roller surfaces move in the direction of movement of said generally horizontal surface along said path;

said power means being connected to rotate said rollers at the same surface speed as said generally horizontal surface is moved; and the diameters of said rollers and the spacing between them at said bite being such that when a said box is moved by said surface past said second point said flanges are pressed close enough together by said rollers for said projection on said one flange to be pressed far enough into said well on said other flange for said locking means to lock said projection in said well, whereby locking said cover in closed position on said box body portion.

14. The apparatus of claim 13 which includes means for moving said rollers vetically up and down relative to said generally horizontal surface in unison.

* * * * *